US007665397B1

(12) United States Patent
Monk et al.

(10) Patent No.: US 7,665,397 B1
(45) Date of Patent: Feb. 23, 2010

(54) PLURAL-PANEL ARMOR SYSTEM

(75) Inventors: Russell A. Monk, Salem, OR (US); Thomas S. Ohnstad, Salem, OR (US)

(73) Assignee: High Impact Technology, LLC, Tigard, OR (US)

( * ) Notice: Subject to any disclaimer, the term of this patent is extended or adjusted under 35 U.S.C. 154(b) by 0 days.

(21) Appl. No.: 11/607,604

(22) Filed: Dec. 1, 2006

Related U.S. Application Data

(60) Provisional application No. 60/749,670, filed on Dec. 12, 2005.

(51) Int. Cl.
*F41H 5/24* (2006.01)

(52) U.S. Cl. ..... 89/36.04; 89/36.01; 89/36.02; 109/80

(58) Field of Classification Search ..... 89/36.01–36.04, 89/36.07–36.09, 36.11–36.12; 109/80, 82–85
See application file for complete search history.

(56) References Cited

U.S. PATENT DOCUMENTS 3,930,452 A * 1/1976 Van Laethem et al. ..... 109/80
4,198,454 A * 4/1980 Norton ..... 428/117
4,732,803 A * 3/1988 Smith, Jr. ..... 428/212
4,822,657 A * 4/1989 Simpson ..... 428/69
4,836,084 A * 6/1989 Vogelesang et al. ..... 89/36.02
5,102,723 A * 4/1992 Pepin ..... 428/223
5,440,965 A * 8/1995 Cordova et al. ..... 89/36.02
5,654,518 A * 8/1997 Dobbs ..... 89/36.02
5,822,936 A * 10/1998 Bateman ..... 52/281
6,253,655 B1 * 7/2001 Lyons et al. ..... 89/36.02
6,568,310 B2 * 5/2003 Morgan ..... 89/36.02
6,698,331 B1 * 3/2004 Yu et al. ..... 89/36.02
6,711,766 B2 * 3/2004 Monk et al. ..... 5/420
6,792,843 B2 * 9/2004 Mohr et al. ..... 89/36.02
6,899,009 B2 * 5/2005 Christiansen et al. ..... 89/36.02
6,945,155 B2 * 9/2005 Cordova et al. ..... 89/36.02
2002/0106503 A1 * 8/2002 Monk et al. ..... 428/314.4
2003/0110932 A1 * 6/2003 Mohr et al. ..... 89/36.02
2003/0221256 A1 * 12/2003 Monk et al. ..... 5/420
2005/0193667 A1 * 9/2005 Henry et al. ..... 52/309.9
2006/0027089 A1 * 2/2006 Cordova et al. ..... 89/36.02
2006/0065111 A1 * 3/2006 Henry ..... 89/36.02
2007/0000377 A1 * 1/2007 Ohnstad ..... 89/36.13
2007/0113729 A1 * 5/2007 Monk et al. ..... 89/36.02
2007/0221052 A1 * 9/2007 Woodfin ..... 89/36.09
2007/0240621 A1 * 10/2007 Qiao ..... 109/26
2008/0011153 A1 * 1/2008 MacDonald ..... 89/36.02

* cited by examiner

*Primary Examiner*—Bret Hayes
*Assistant Examiner*—Michael D David
(74) *Attorney, Agent, or Firm*—Jon M. Dickinson, PC; Robert D. Varitz, PC

(57) ABSTRACT

A plural-panel, plural-layer armoring system including (a) an outer layer of elongate, side-by-side adjacent, laterally-interlocking, hardened-material armor panels having long axes substantially paralleling one another, and (b) a contacting, but not bonded-to, inner layer of elongate, side-by-side adjacent, closed-cell foam panels having long axes substantially paralleling one another and disposed at angles relative to the long axes of the armor panels.

4 Claims, 1 Drawing Sheet

PLURAL-PANEL ARMOR SYSTEM

CROSS-REFERENCE TO RELATED APPLICATION

This application claims priority to the filing date, Dec. 12, 2005, of currently co-pending U.S. Provisional Patent Application Ser. No. 60/749,670 covering an invention entitled "Plural-Panel Armor System". The entire disclosure content of that prior-filed provisional application is hereby incorporated herein by reference.

BACKGROUND AND SUMMARY OF THE INVENTION

This invention pertains to a plural-panel armor system. In particular, it pertains to such a system which includes an outer, or exposed, layer of side-by-side, hardened-material, elongate, ballistic armor panels, such as armor steel panels, and an underlying, contactively-engaged but not bonded, layer of side-by-side, closed-cell, extruded, elongate, polyethylene foam panels. The long axes of the panels in each of the two, respective layers preferably lie orthogonally relative to those of the panels in the other layer.

A particular kind of setting, namely, a military setting, has prompted the conception and reduction to practice of the present invention. This setting involves military troops and support personnel in a combat zone wherein housing, office space, etc. each takes the form of conventional, elongate, rectilinear shipping-container units having heights of about 8-feet, depths also of about 8-feet, and lengths of about 20-feet.

The present invention recognizes, with respect to such container units, the lack of adequate overhead (roof) protection from both blast and projectile type attacks (threat events)—events which threaten the safety of anyone inside one of these units. In particular, the present invention directs specific attention to a unique, layered, plural-panel armoring system, or armor system, which is intended, and has been found, to provide impressively adequate shielding, and thus protection, against overhead-incoming ballistic-projectile and blast events. Moreover, and as one will observe on reading the content of the disclosure herein, the proposed plural-panel armoring system of this invention, in addition to furnishing anti-ballistic-projectile and anti-blast protection, also offers features of both heat and sound insulation, and does so with materials which, importantly, do not add any attendant fire hazard.

These and other features and advantages offered by the present invention will become more fully apparent as the detailed description thereof which follows below is read in conjunction with the accompanying drawings.

DETAILED DESCRIPTION OF THE INVENTION

Figure 1:
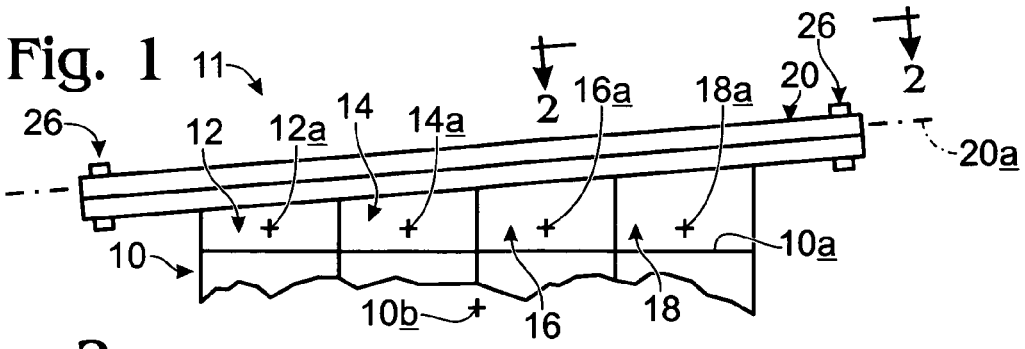
FIG. 1 is a fragmentary, simplified end view of the upper portion of a container "housing unit", on top of which has been installed a modestly inclined (sloped upper "surface") plural-panel armoring system constructed in accordance with the present invention.
Figure 2:
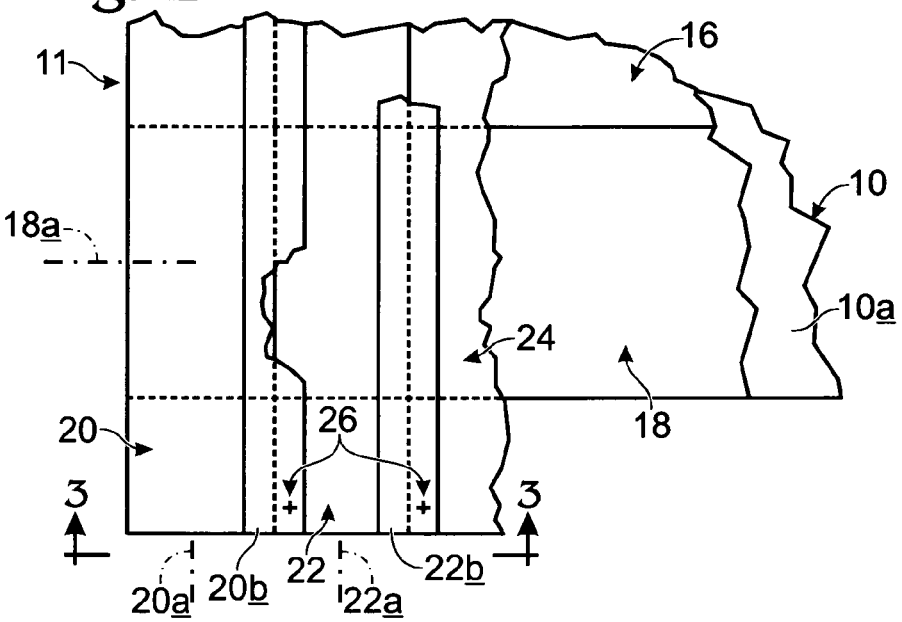
FIG. 2 is a fragmentary and somewhat enlarged 90-degree clockwise-rotated view taken generally along the line 2-2 in FIG. 1.
Figure 3:
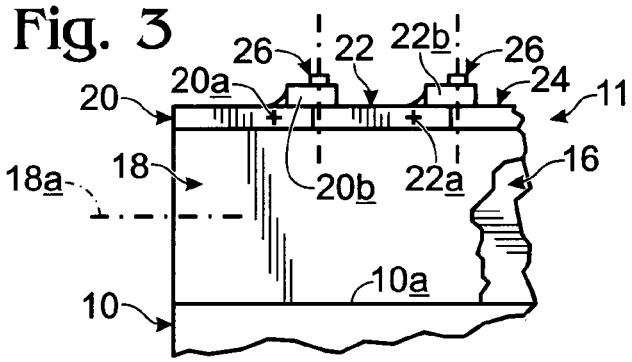
FIG. 3 is a fragmentary view taken generally along the line 3-3 in FIG. 2.
Figure 4:
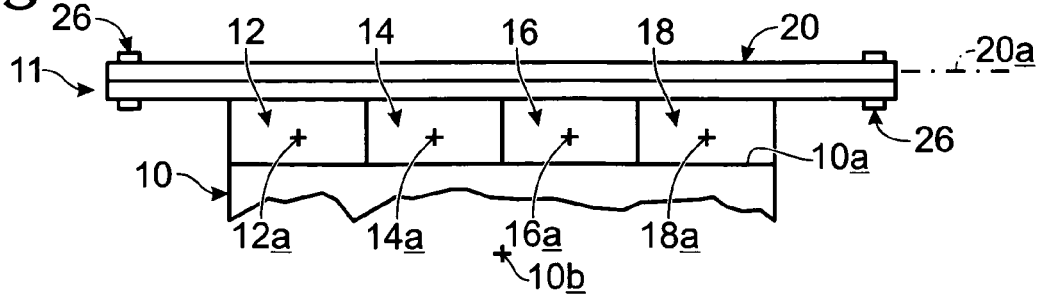
FIG. 4 is similar to FIG. 1, except that it shows another form of the invention in which the upwardly exposed surfaces of the upper panels in the armoring panel system of the invention lie in a horizontal, rather than in an inclined, plane. Such an inclined plane, which is shown in FIG. 1, illustrates implementation of the invention in a situation where it is desired to provide for rainwater and snow-melt drainage.

In FIGS. 1 and 4, the upper end portion of a housing container, or unit, is shown at 10, with this unit having an overhead, generally horizontal roof structure 10*a* which lies in a plane that is substantially normal to the plane of FIGS. 1 and 4. This "roof plane" generally parallels the long axis 10*b* of container 10.

Disposed on and along the upper surface of roof structure 10*a* in these two figures is a plural-panel armoring (or armor) system 11 which is made in accordance with the present invention. Included in system 11 are four, side-by-side-adjacent, elongate panels 12, 14, 16, 18 which have (a) lateral dimensions in FIGS. 1 and 4 of about 2-feet, (b) longitudinal dimensions (extending into the planes of FIGS. 1 and 4) of about 20-feet, and (c) thicknesses which, in FIG. 1, vary with lateral, wedge-like tapers, as shown, to produce the modest, upper-surface lateral inclination which is illustrated. The thicknesses of these four panels as shown in FIG. 4 are uniform, i.e., not tapered. They are the same. The longitudinal axes of panels 12, 14, 16, 18 appear at 12*a*, 14*a*, 16*a*, 18*a*, respectively, with these axes substantially paralleling the container's long axis 10*b*. Panel 12 in FIG. 1 varies in thickness from about 1-inch at its left side in this figure to about 1¾-inches on its right side. Panels 14, 16, 18 are similarly dimensionally varied laterally so that a smooth taper, as is shown in FIG. 1, exists to give the overall armoring structure of this invention the upper-side, inclined disposition which is pictured in FIG. 1. In FIG. 4, each of panels 12, 14, 16, 18 preferably has a common and uniform thickness of about 2-inches.

These four panels are formed herein preferably of an extruded, anti-static, flame-resistant, polyethylene, closed cell foam, such as either one of two, somewhat different-density polyethylene foams made by Sealed Air Corporation of Saddle Brook, N.J. and sold under that manufacturer's product designations "2.2# (pcf) Celluplank® FR" and "9# (pcf) Celluplank® FR". As was just above mentioned, these two different materials distinguish from one another principally in density, with the material designated "9#, etc." being somewhat more dense than the material designated "2.2#, etc.". Both of these materials have been found to perform admirably well as components in the plural-panel armor structure 11 of this invention, with the "9#" material providing a somewhat more robust anti-threat protection. With respect to the general, above-indicated sizes of panels 12, 14, 16, 18 as shown in FIGS. 1 and 4, each of these panels is extremely light in weight, with each panel, in all cases, weighing less than about 20-pounds. Panels 12, 14, 16, 18 effectively rest without any special anchor mechanism on the upper surface of roof structure 10*a*. These lightweight foam panels can be placed and removed with respect to such a roof structure very quickly and easily.

Cooperating with panels 12, 14, 16, 18 in another, upper (or outer) layer of plural panels, are side-by-side-adjacent, elongate, hardened-material, armor panels, such as the three which are shown at 20, 22, 24. These panels are preferably formed of any suitable and conventional armor steel (hardened) material, with each panel having a thickness herein preferably of about ¼-inches, a width of about 1-foot, and a length of about 10-feet. The long axes of these panels, shown at 20*a*, 22*a* for panels 20, 22, respectively, parallel one another, and extend generally at right angles both to container axis 10*b* and to previously mentioned panel axes 12*a*, 14*a*, 16*a*, 18*a*.

Hardened armor panel material other than steel may, of course, be employed for panels, like panels 20, 22, 24, if desired. The particular hardened panels illustrated herein have been made of a hardened steel material made by Oregon Steel Mills in Portland, Oreg. out of one or the other of that company's steel products sold under the designations Mil-A-46100D(MR) and Mil-A-12560G(MR).

Joined as by welding to and extending slightly laterally beyond one, lateral, long edge of each of these armor steel panels is an armor steel flange, such as flanges 20*b*, 22*b* shown weld-attached to the upper sides of panels 20, 22, respectively. These flanges are preferably also made of one or the other of the two, above-identified Oregon Steel Mills products. Adjacent opposite ends of laterally outwardly extending portions of these flanges, which flanges are also referred to herein as lateral overlap structure, are appropriate bolt holes (not shown) which are intended to align with prepared, similar bolt holes (also not shown) created directly in the armor panels themselves so as to allow for quick and easy interlock-fastening of adjacent armor panels, as by nut-and-bolt sets, such as those shown generally at 26.

In the embodiments of system 11 which are shown herein, and with respect to the dimensions described for the metal armor panels above, each of these armor panels and its associated welded flange structure weighs about 100-pounds. Thus, these panels can easily be handled by two people for installing and removing them with respect to the underlying polyethylene panels in system 11.

There is thus provided an armoring system including plural panels arranged in two layers with an upper layer formed of metallic, or other suitable hardened-material, armor panels having long axes extending in one set of common directions, overlying an underlying set of orthogonally arranged, elongate, closed-cell, polyethylene foam panels which simply rest beneath the hardened armor panels without being bonded to them in any way. Preferably, the long axes of the underlying foam panels parallel that (10*b* of a "protected" container unit. The long axes of the overlying, hardened-material panels preferably lie orthogonally relative to a "protected" container unit's long axis.

This arrangement creates a special kind of cooperative, but not bondedly-connected, interactive participation by the two layers of system 11. This arrangement has proven to provide significantly and notably effective ballistic-projectile, and blast, protection with respect to overhead threat events of the two natures mentioned above herein. Among other things, the presence of the closed-cell, polyethylene panels beneath the hardened armor panels provides special reinforcement for the hardened, overhead panels, and has been shown to provide significant energy absorption and dissipation. With respect to direct, high-speed projectile strikes, such as bullet, etc. strikes, the system of the present invention has demonstrated an ability, during such an event, to change the trajectory of a striking object in ways that significantly minimize the penetrating dangers presented by such objects.

Obviously, the system of the present invention provides a quick and easy solution to the issue of providing overhead blast and ballistic protection for personnel housing structures, such as container units like container unit 10. The elements of the invention are easily transported as stacked, bulk materials for rapid movement from one location to another, and can quickly and easily be put into and removed from operative placement with respect to the roof structures of units, such as that of container unit 10.

While the plural-panel, plural-layer, differentiated-material armoring structure and system of the present invention has been developed specifically to deal with protecting the overhead, or roof, areas of personnel units, such as container unit 10, we appreciate that a similar plural-layer, plural-panel arrangement may be oriented in other planes, such as in vertical planes, to provide similar kinds of protection against lateral ballistic and blast threats. We also understand that other variations and modifications of the invention may be made, and will become to those generally skilled in the relevant art, and it is intended that all such variations and modifications will come with in the scope and spirit of the invention.

We claim:

1. A plural-overlapping-panel, plural-layer armoring system consisting of (a) an outer layer of elongate, side-by-side adjacent, laterally-interlocking, hardened-material armor panels having long axes substantially paralleling one another, and (b) a contacting and overlapping, but not bonded-to, inner layer of elongate, side-by-side adjacent, closed-cell foam panels having long axes substantially paralleling one another and disposed at angles relative to the long axes of the hardened-material armor panels, each hardened-material panel having a long dimension following its long axis and extending, in a overlapping sense, beyond the lateral margins of plural ones of said foam panels, and each foam panel having a long dimension following its long axis and extending, in a overlapping sense, beyond the lateral margins of plural ones of said hardened-material panels.

2. The system of claim 1, wherein interlocking between adjacent armor panels is produced by lateral overlap structure which is joined to long lateral edges of these panels on one side of each panel.

3. The system of claim 1, wherein the "angles" mentioned are right angles.

4. The system of claim 1, wherein the armor panels are steel armor panels.

* * * * *